United States Patent [19]

Devey

[11] Patent Number: 4,951,875

[45] Date of Patent: Aug. 28, 1990

[54] DIPOSABLE LINER SYSTEM FOR SPRAY GUNS

[76] Inventor: Daniel A. Devey, 8692 Via Alta Way, Elk Grove, Calif. 95624

[21] Appl. No.: 245,910

[22] Filed: Sep. 19, 1988

[51] Int. Cl.[5] ..... B05B 1/28

[52] U.S. Cl. ..... 239/104; 239/288; 239/288.3

[58] Field of Search ..... 239/104–105, 239/288, 288.3, 288.5, 327, 362, DIG. 14

[56] References Cited

U.S. PATENT DOCUMENTS

| | | | |
|---|---|---|---|
| 2,888,173 | 5/1959 | Wolcott . | |
| 3,136,486 | 6/1964 | Docken | 239/302 |
| 3,255,972 | 6/1966 | Hultgren . | |
| 3,674,074 | 7/1972 | Lavis | 239/288 X |
| 3,714,967 | 2/1973 | Zupan et al. . | |
| 4,405,088 | 9/1983 | Gray . | |
| 4,471,911 | 9/1984 | Hengesbeck . | |

FOREIGN PATENT DOCUMENTS

| | | | |
|---|---|---|---|
| 72920 | 7/1951 | Denmark | 239/327 |

*Primary Examiner*—Andres Kashnikow
*Assistant Examiner*—William Grant
*Attorney, Agent, or Firm*—Bernhard Kreten

[57] ABSTRACT

A liner system for a spray gun including three liners, one of which resides within the interior of a spray gun reservoir, a second of which rides on an outside of the reservoir, a third of which is interposed between the reservoir and attached to a spray head via bayonet hook and has a free end which serves as a shield when placed over the spray head, just upstream from the nozzle. These liners minimize down time when cleaning spray guns and reduce the amount of solvent required.

17 Claims, 2 Drawing Sheets

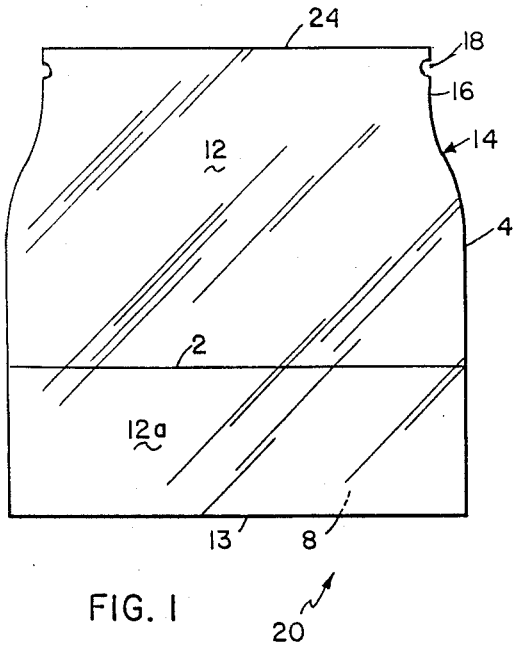
FIG. 1
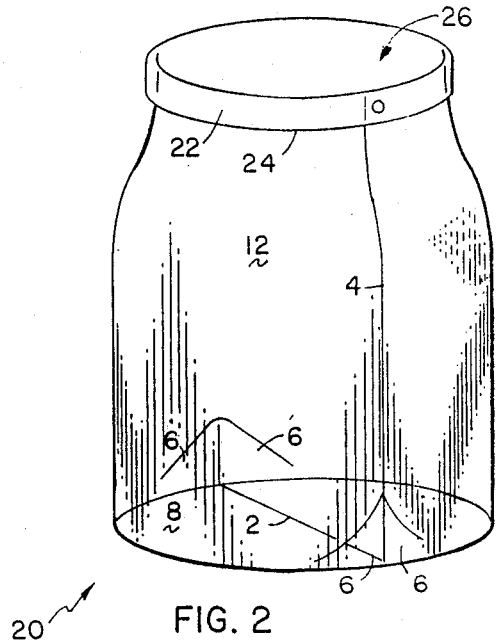
FIG. 2
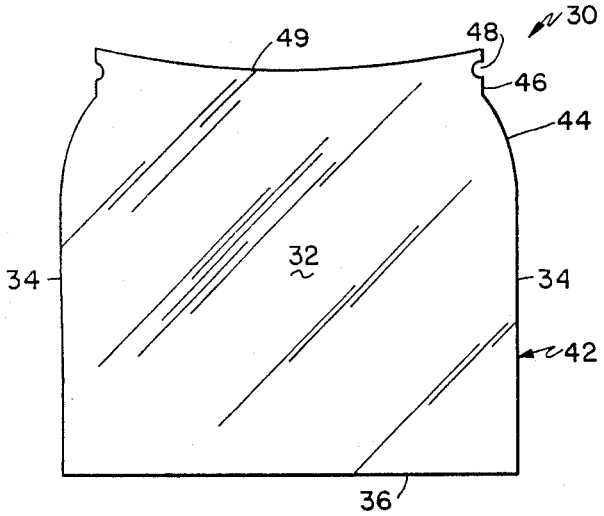
FIG. 3
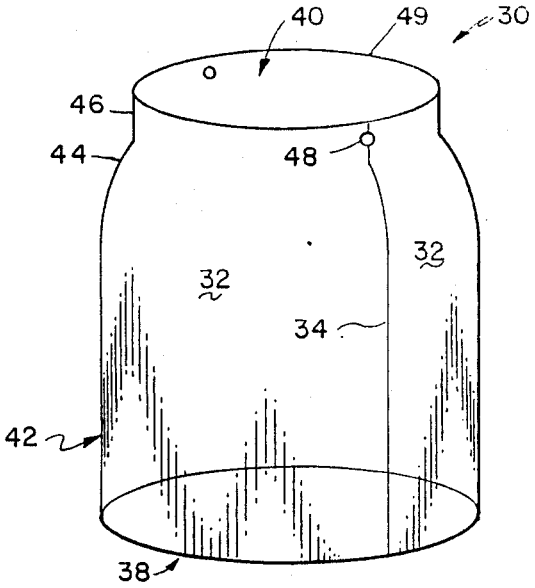
FIG. 4
FIG. 5
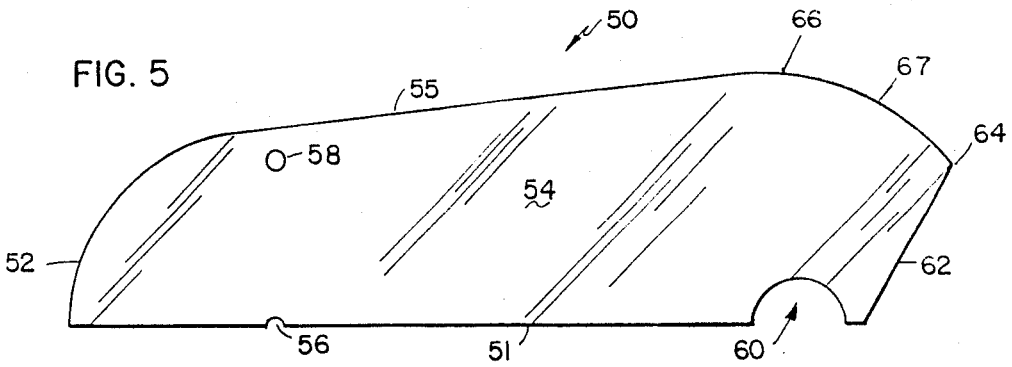

DIPOSABLE LINER SYSTEM FOR SPRAY GUNS

FIELD OF THE INVENTION

The following invention relates generally to a disposable liner system for use with paint type spray guns. More particularly, the subject liner system facilitates changing a single spray gun from one color to another color with a minimal amount of down time and a reduced volume of cleaning solvent.

BACKGROUND OF THE INVENTION

Using spray guns to paint cars, houses, or other instrumentalities saves considerable time for the actual painting operation. However, when one job has been completed, a professional must clean his equipment in preparation for subsequent work.

Three forms of inefficiency arise at this juncture. First, since the painter is a skilled artisan, the chore associated with cleaning the equipment constitutes an inefficient usage of the skilled artisan's time. This loss of time can be considerable in industries such as the auto industry where color changes are frequent during the course of the day. This is true particularly when touch-ups or spray jobs entail spraying less than an entire vehicle. Second, the cleaning process while tedious, must be thorough. When using the gun for a subsequent job, the gun must be thoroughly cleaned to avoid contamination of the subsequent work. Third, cleaning has traditionally involved the use of solvents which are expensive and hazardous to the environment. Indeed, although barrels of solvent may sell for as little as $200.00 per barrel, the solvent cannot be reused and once contaminated must be transported to a toxic waste site where the disposal charge can exceed $250.00 per barrel.

The following patents reflect the state of the art of which applicant is aware and is tendered in response to applicant's acknowledged duty to disclose prior art. It is stipulated that the relevance of these patents is at best coincidental with the instant invention.

| | |
|---|---|
| 3,255,972 | Hultgren |
| 4,405,088 | Gray |
| 3,714,967 | Zupan, et al |
| 4,471,911 | Hengesbach |
| 2,888,173 | Wolcott |

The patent to Hengesbach teaches the use of a spraying apparatus and method wherein the conventional spray gun has been modified to receive disposable containers to facilitate changing from one spray liquid to another. Thus, to facilitate the use of interchangeable containers, the spray gun lid is modified from normal mass produced spray gun lids to threadably fasten to the container.

The patent to Hultgren teaches the use of a collapsible container mounted within a rigid container and includes an aspirating tube extending into the collapsible container.

The patent to Grey teaches the use of an adapter for disposable cans which can be coupled to siphon type spray paint guns to achieve objectives similar to Hengesbach.

Zupan, et al is concerned with minimizing the amount of paint drip when using a siphon type spray gun assembly. To offset paint drip, a vent passageway is provided to alleviate the problem.

Finally, Wolcott teaches the use of a reusable pressurized container wherein an inner container is removeably mounted within the outer container for holding a quantity of material to be dispensed and a pressurized propellent.

First, it should be pointed out that known prior art teachings, while perhaps effective in alleviating certain problems, generate others because of the manner in which their solutions have been effectuated. For example, some appear objectionable because they require modification of existing paint equipment which can meet with considerable resistance on the part of the user. None of the teachings lend themselves to retrofitting on existing equipment without modification.

Structurally, users may find objectionable these known prior art teachings in that first, the rapid turnover from one fluid to the next would appeal primarily to professionals who have considerable experience in their field. Accordingly, a certain degree of reluctance exists in surrendering or modifying their familiar equipment some of which can be quite expensive, in exchange for an unknown quantity. Second, many of these modifications adversely affect the ergometric efficacy of the existing system particularly with respect to balance and weight.

SUMMARY OF THE INVENTION

The instant invention is distinguished over the known prior art in that an instrumentality has been provided which in its ideal form involves the use of three light weight liners. A first liner is configured to have an external configuration complimental to the interior of the fluid reservoir and is formed from light plastic which is easily conformable to the interior of the reservoir particularly when filled with a liquid such as paint. A second liner is included which circumscribes the outer periphery of the paint reservoir to protect the reservoir from paint spray, paint drips or other contamination, to protect the outer surface thereof. A third, further liner is included which is interposed between the opening of the reservoir and the spray gun lid which seals the reservoir and has an outwardly extending portion configured such that when suitably oriented passes over the spray nozzle outlet to provide a shield along the handle and trigger area of the spray gun by serving as a further shield to preclude spray from reaching the hand held area of the spray gun. The third liner also inhibits paint from passing through the vent system.

In this manner, when a transition is required between successive jobs, one merely has to separate the spray head from the reservoir, remove the third, further liner, slide the used first liner from within the interior of the reservoir, and slip off the exterior second liner to completely remove all vestiges of the prior paint except for the area of the spray gun which came in contact with the paint in the reservoir, i.e. the siphon tube. Merely pouring a small quantity of solvent into the reservoir, reconnecting the gun to the reservoir, and thereafter running the solvent through the gun, renders the spray gun ready for the next job. To appreciate the magnitude of the improvement according to the instant invention when compared to the known prior art, it should be remembered that only the siphon tube, spray cap, and the interior passageways in the spray gun retain residue from the prior painting operation. Heretofor, the entire interior of the reservoir had paint residue and in many instances, the exterior of the reservoir and the spray head itself required immersion in solvent to clean the gun. With the present invention, what may have required 32 to 48 oz. of solvent and 10 to 15 minutes time now requires no more than a half pint of solvent and 2 to 3 minutes time.

OBJECTS OF THE INVENTION

Accordingly, it is a primary object of the present invention to provide a new and useful liner system associated with spray guns for facilitating cleaning of the spray gun between successive jobs.

A further object of the present invention is to provide a device as characterized above which utilizes liner material commonly available, such as polyethylene which has been fashioned to accommodate mass production techniques whereby a liner can be provided for such a nominal cost, that in comparison to known prior art techniques, heretofor long standing yet unresolved difficulties will have been resolved.

It is yet a further object of the present invention to provide a device as characterized above which is extremely durable in construction, safe to use and lends itself to mass production techniques.

A further object of the present invention contemplates providing a device as characterized above which substantially decreases the quantum of solvent required in cleaning a paint gun for successive operation.

A further key object is to save as much as 90 percent of the time heretofore required in cleaning the gun.

Viewed from one vantage point, an object of the present invention is to provide a disposable liner for spray gun or the like wherein the spray gun is of the type having a fluid reservoir and a separable spray head which includes a first liner having an external configuration complimental to interior walls of the reservoir placed in the reservoir and including an opening at a top of the liner, and an instrumentality to secure the liner to the reservoir whereby the fluid normally stored in the reservoir resides in the liner to reduce both time in cleaning the spray gun and the amount of cleaning solvent.

Viewed from a second vantage point, it is a primary object of the present invention to provide a device as characterized above embodied as a kit for minimizing both spray gun cleaning time and the volume of solvent required wherein the kit includes three liners, a first of which lines an interior of a spray gun reservoir, a second which circumscribes the reservoir's outer periphery, and a third which both shields a spray head and serves as a gasket between the reservoir and the spray head.

Viewed from a further vantage point, another object of the present invention is to provide a method for using a spray gun, the steps including opening the gun to expose the interior of the gun's reservoir, inserting a first liner, locking the liner to the gun, filling the liner with fluid, closing the gun and spraying. Preferably, the outer liner is installed, then the inner liner is installed and folded over the top of the reservoir. The third liner attaches to the spray head.

These and other objects will be made manifest when considering the following detailed specification taken in conjunction with the appended drawing figures.

BRIEF DESCRIPTION OF THE DRAWING FIGURES

FIG. 1 is a side view of the first liner according to the present invention in a folded, flattened, stored condition.

FIG. 2 is a perspective view of that which is shown in FIG. 1 in an expanded, deployed condition.

FIG. 3 is a side view of a second liner according to the present invention in a folded, flattened position.

FIG. 4 is a perspective view of that which is shown in FIG. 3 in an expanded, deployed configuration.

FIG. 5 is a side view of a third, further liner in a folded and stored configuration.

BRIEF DESCRIPTION OF THE PREFERRED EMBODIMENT

Figure 7:
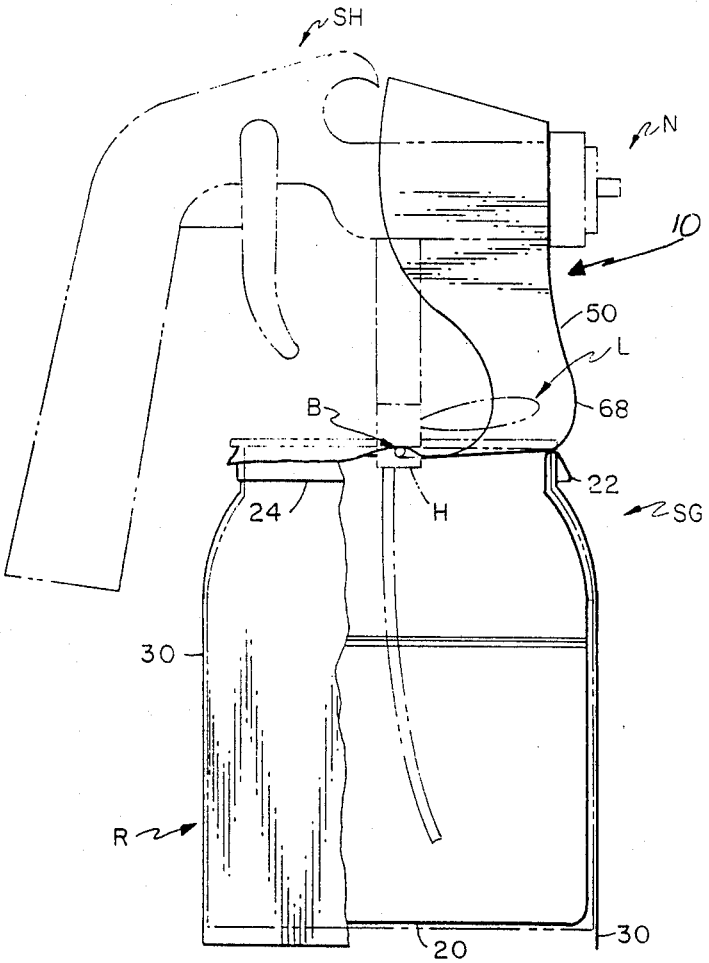
FIG. 7 is a side view of the three liners shown in FIGS. 1–6 deployed on a spray gun, portions of which have been fragmented for clarity.

Referring to the drawings now, wherein like reference numerals refer to like parts throughout the various drawing figures, reference numeral 10 is directed to the shield system according to the present invention.

In its essence, the shield system 10 includes a first liner 20, a second liner 30 and a third, further liner 50 which collectively envelope respectively, an interior of the reservoir R, an exterior of the reservoir R and an upstream portion of the spray gun's spray head SH.

With reference to FIGS. 1 and 2, the first liner 20 of the shield system 10 includes a central axis of symmetry 2 which allows an initial blank of material to be folded in half and appropriately seamed to define the first liner 20. By folding the blank defining the first liner 20 along the axis 2, a pair of side walls 12 are formed which include a bottom wall 8 which leads to the axis of symmetry 2. As shown in FIG. 1, a lower portion 12*a* of the liner 20 is four ply when the liner is in its folded position of FIG. 1. In this case, the bottom wall 8 is folded in half and extends upwardly to reside within the two side walls, toward the crease defining the axis of symmetry 2. When the bag is to be deployed, the crease 2 is pushed downwardly to place the bottom walls 8 in a substantially horizontal plane which causes two pairs of the triangular gussets 6 to extend on either side of the axis of symmetry corresponding to each half of the bottom wall 8. The gussets represent portions of the two plies of material forming the bottom wall 8 which fold up against the side walls 12 in a substantially triangular fashion so that when deployed, the bottom wall is substantially circular in configuration and a lower portion 12*a* of the liner 20 is substantially cylindrical. Note that in FIG. 1 the lower most edge 13 of the folded liner 20 of FIG. 1 is substantially linear. This structure results in a liner closely conforming to a standard reservoir.

Figure 8:
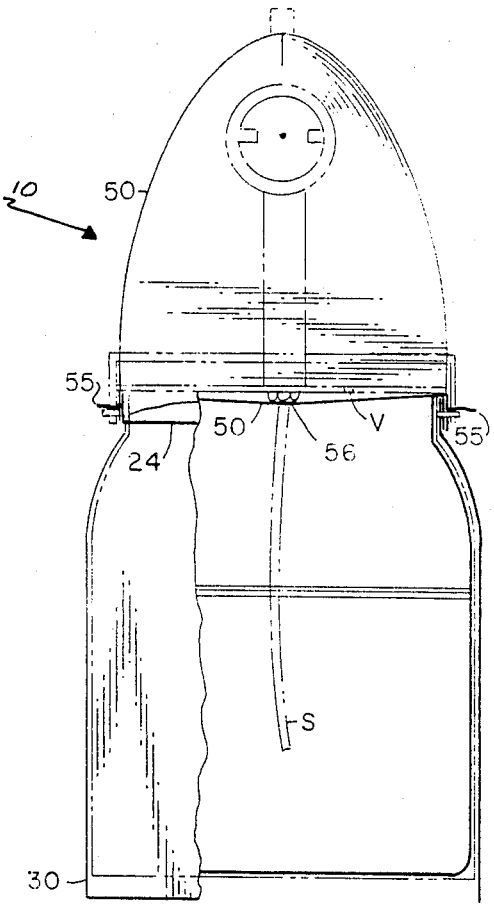
FIG. 8 is a front view of that which is shown in FIG. 7 with further fragmentation of the spray gun to further enhance the understanding of the invention.

Because most paint reservoirs have a cylindrical lower portion which tapers up near the area of interconnection with the spray head SH, the liner 20 includes a similarly necked down taper 14 to conform with the reservoir. Thereafter, the liner 20 extends upwardly into a linear portion 16 and terminates in a planar top edge 24 defining an opening 26 when the two panels forming the liner are seamed at exterior edges thereof as shown by seams 4. As shown in FIG. 2, the planar top edge 24 is turned over to provide a doubled portion 22 and expose bayonet holes 18 on the turn over 22. The bayonet holes 18 cooperate with bayonet pins B on a conventional reservoir R. FIGS. 7 and 8, for example show the bayonet supporting the inner liner 20 via the bayonet holes 18.

Note that suitable plastic is commercially available having the lower portion 2, 6, 12*a*, 13, etc. preformed on a roll. In such event, contouring and seaming along 4 and providing holes 18 are all that is required. Note also that other linear configurations (e.g. no gusset and curved lower edge 13 would still fit in a reservoir but not be so well tailored).

Attention is now directed to FIGS. 3 and 4 which reflect a second liner 30 to be used on the outer periphery of the reservoir R. As shown, the second liner 30 includes a pair of panels 32 seamed together at edges 34 so that, when expanded (FIG. 4) a somewhat cylindrical shaped liner has been provided. The bottom edge 36 of each panel 32 is substantially linear so that when expanded a generally circular bottom opening 38 is provided. In manufacturing, the bottom edge 36 can serve as an axis of symmetry where both panels are formed from a single sheet of material and doubled over adjacent the bottom edge 36 for seaming 34 along the edges, and thereafter the bottom edge 36 is cut to provide the opening 38. A lowermost portion along the outer edge of each panel defines substantially linear lower walls 42, which taper at 44 where the panels extend upwardly to closely conform to the configuration of conventional reservoirs R. Thereafter, a linear upper wall 46 is provided which includes bayonet apertures 48 to affix to the bayonets B on a conventional spray gun SG. When expanded as shown in FIG. 4, a top opening 4 is provided which is substantially circular and is formed by cutting the panels 32 so to have an arcuate top edge 49 as shown in FIG. 3.

In a preferred form of the invention the second, outer liner is placed on the reservoir initially and the first, inner liner is then installed with the turn over 22 overlying the liner 30 and fixed on pins B.

Figure 6:
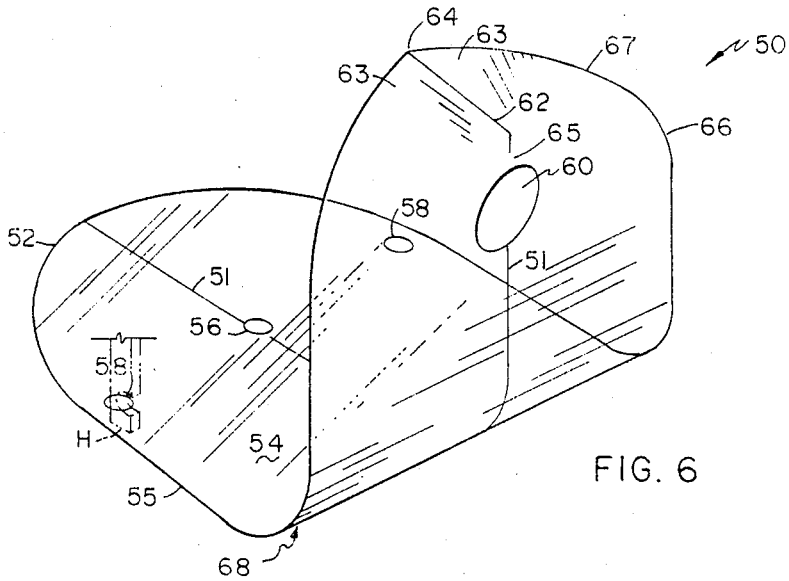
FIG. 6 is a perspective view of the liner shown in FIG. 5 in an unfolded, deployed configuration.
Figure 7:
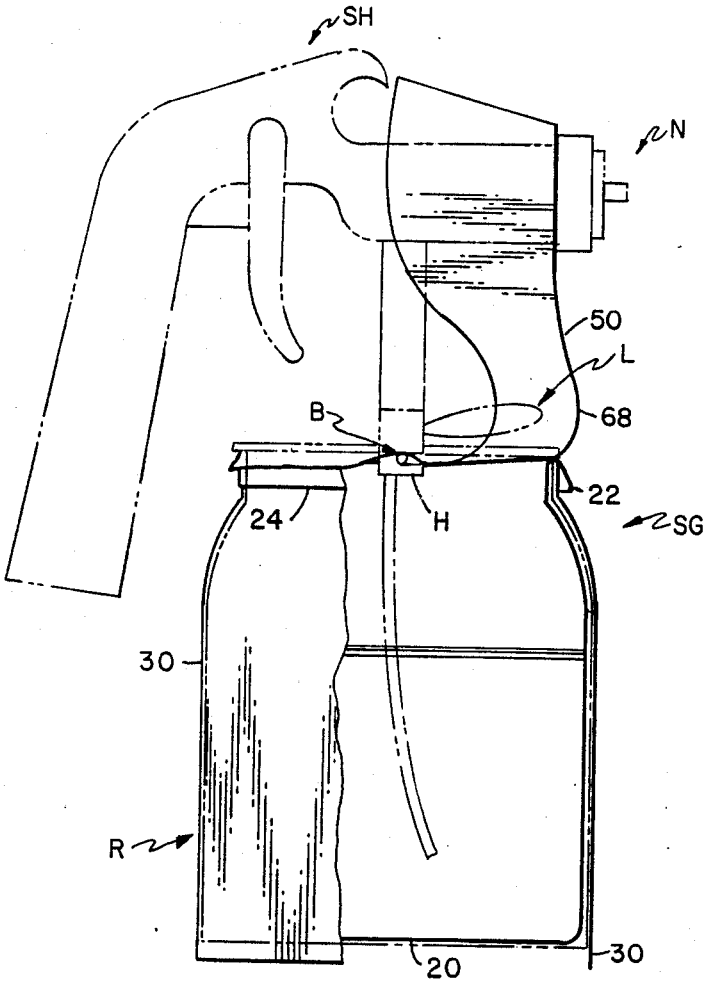
Figure 8:
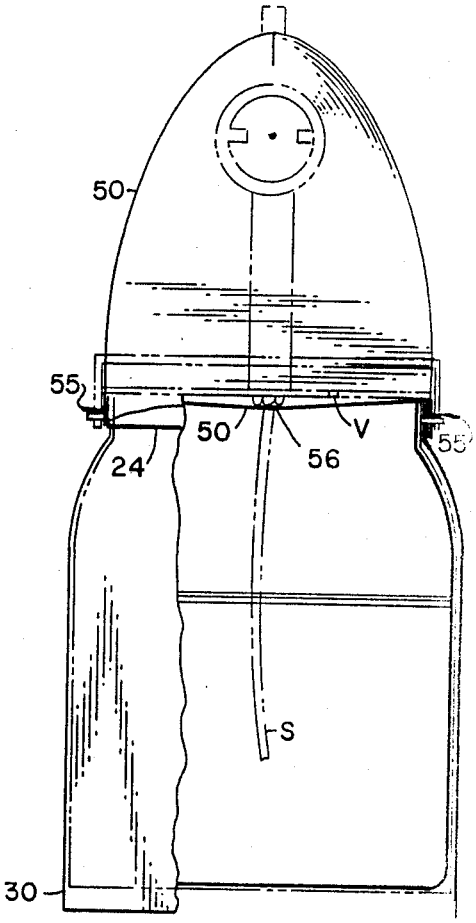
Figure 6:
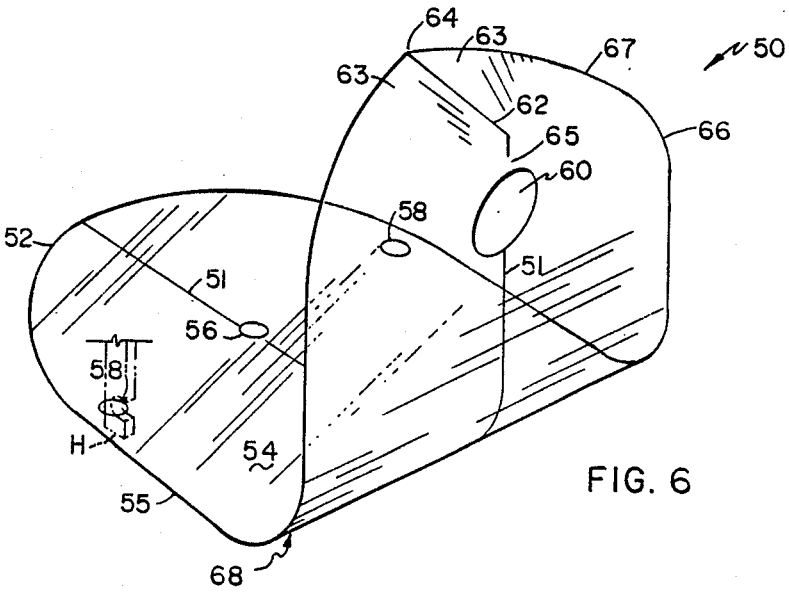

With respect to FIGS. 5 and 6, the third further liner 50 can now be detailed. As shown in FIG. 5, the folded, stored version of the third liner 50 has an axis of symmetry along a longitudinally extending medial line 51 which may be formed as a permanent crease in the one piece of polyethylene. The third liner 50 includes one end 52 which is arcuate and has a radius which is substantially that of the mouth of the reservoir. The radius of curvature for the arcuate one end 52 extends to a line perpendicular to the medial line 51 and located at a central siphon orifice 56. Along this line, two offset bayonet hook orifices 58 are placed for alignment with the bayonet hooks H on the spray head SH. This allows the third liner to be carried on the spray head. The liner 50 includes a diverging medial portion 54 having linear medial edges 55 extending away from the arcuate one end 52. The medial portion 54 and its associated medial edges 55 continue to diverge outwardly until they crest at 66 which corresponds with another perpendicular line extending from the medial line 51. Approximately at the same point where a nozzle hole 60 has been placed through the liner 50. Thereafter, the liner edge 67 beyond the crest 66 tapers back towards the medial line 51 to form a peaked other end 64. Since it is preferred that this third liner 50 be formed from a single panel of polyethylene, the peak 64 is enhanced by use of a seam 62 which unites two free ends 63 of the liner. The seam is preferred to join together these free ends 63 because material from the liner between the free ends 63 had been removed so that, upon seaming, the free ends 63 will cause this peaked end 64 to naturally stand up. A non-cut area 65 is immediately between the seam 62 and the nozzle hole 60. This uncut area coupled with the seam 62 and the gathered together free ends accentuates the peak 64.

With reference to FIGS. 7 and 8, it can be seen that the peak 64 coupled with the nozzle hole 60 allows the third liner to be placed over the nozzle N, just upstream therefrom and a bend 68 in the third liner occurs naturally just beyond the area where the reservoir connects with the spray head SH. This third liner serves not only the function of protecting the spray head SH from mist generated during the spraying process, but also provides an improved gasket between the spray head SH and the reservoir R. The bayonet hook orifices 58 overly the bayonet hooks H on the reservoir R to reliably secure the third liner 50 on the spray gun SG. The third liner prevents paint from passing through vent V because the liner obscures the vent.

In use and operation, and with respect to FIGS. 7 and 8, a spray gun SG is dissociated into its two components, the reservoir R and the spray head SH. The interior of the reservoir R receives the first liner 20 which conforms substantially to the internal dimension and configuration of commercial reservoirs after the second liner 30 has been slid over the reservoir R and aligned such that the apertures 48 of the second liner are located on the bayonet pins. The turn over 22 on the first liner 20 overlies both the top edge of the reservoir R and a top edge 49 of the second liner 30. The bayonet holes 18 of the first liner 20 are located on the bayonet pins. Next, the liner 20 is filled with the appropriate amount of fluid, such as paint to the appropriate level. Next, the further third liner 50 is located such that the orifices 58 on the bayonet hooks and hole 56 of the third liner 50 passes over the siphon tube S. Finally, the spray head SH is connected to the reservoir through the bayonet pins by hooks thereby sealing the spray head to the reservoir and allowing the peaked end 64 of the third liner to be placed over the nozzle N providing a shield for the upper portion of the spray gun. The device is then used as intended. Upon clean up, one throws away all three liners, wipes off the siphon tube and nozzle, places a small amount of solvent in the reservoir, reconnects and runs the solvent through the spray gun, and reapplies new liners for successive painting.

Moreover, having thus described the invention, it should be apparent that numerous structural modifications and adaptations may be resorted to without departing from the scope and fair meaning of the instant invention as delineated hereinabove and as defined hereinbelow in the claims.

I claim:

1. A disposable liner for spray guns wherein the spray gun is of the type having a fluid reservoir and a separable spray head, comprising, in combination:

a first liner having an external configuration complemental to interior walls of the reservoir, placed in the reservoir and including an opening at the top of said liner, and means to secure said liner to the reservoir, whereby the fluid normally stored in the reservoir resides in said liner to reduce both time in cleaning the spray gun and volume of cleaning solvent, and, including a second liner having an internal configuration complemental to exterior side walls of the reservoir and placed over the reservoir to reduce both time in cleaning the spray gun and volume of cleaning solvent.

2. The device of claim 1 including a third liner interposed between the reservoir and the spray head and having a skirt portion extending over the spray head thereby defining a spray head shield to protect portions of the spray head upstream from a spray head nozzle from fluid exiting the nozzle.

3. The device of claim 2 wherein said means to secure said first liner to said reservoir include bayonet holes passing through said first liner and oriented to align with bayonet pins contained on the reservoir, whereby turning over a top most portion of said first liner allows access of said bayonet holes to locate the bayonet pins.

4. The device of claim 3 wherein said first liner is formed with an axis of symmetry such that when folded a diametral line of a bottom wall defining a portion of said first liner corresponds with the axis of symmetry, and forms a lower portion of said first liner as a substantially four ply rectangular panel, but when deployed reorients such that a substantially cylindrical side wall is formed with a circular bottom wall and two pairs of triangular gussets oriented adjacent each end of said axis of symmetry adjacent an inner portion of said side wall.

5. The device of claim 4 wherein said second liner includes a bottom opening, a top opening and a pair of panels defining side walls seamed together along edges thereof and includes apertures adjacent a top edge thereof oriented to locate with the bayonet pins on the reservoir.

6. The device of claim 5 wherein said third further liner is formed as a blank of material having a medial line defining mirror symmetry on either side thereof, an arcuate one end, a diverging medial portion, an area of transition between said arcuate one end and said diverging medial portion including bayonet hook orifices slightly inboard said area of transition and in line with a central siphon orifice disposed on said medial line, a peaked other end including a nozzle hole disposed on said medial line, and, at an outer periphery thereof, said third liner having a crested area generally aligned with said hole on a line perpendicular to said medial line, thereafter tapering to said peaked other end including a seam to join free ends of said blank thereby accentuating the peak.

7. A kit for minimizing both spray gun cleaning down time and the volume of solvent required, the kit comprising:

three liners, a first liner which lines an interior of a spray gun reservoir, a second liner which circumscribes the reservoir's outer periphery, a third liner which both shields a spray head and serves as a gasket between the reservoir and the spray head.

8. The kit of claim 7 including means to secure said first and second liner to said reservoir include bayonet holes passing through said first and second liners and oriented to align with bayonet pins contained on the reservoir, and turning over a top most portion of said first liner allows access of said bayonet holes to locate the bayonet pins.

9. The kit of claim 8 wherein said first liner is formed with an axis of symmetry such that when folded a diametral line of a bottom wall defining a portion of said first liner corresponds with the axis of symmetry, and forms a lower portion of said first liner as a substantially four ply rectangular panel, but when deployed reorients such that a substantially cylindrical side wall is formed with a circular bottom wall and two pairs of triangular gussets oriented adjacent each end of said axis of symmetry adjacent an inner portion of said side wall.

10. The kit of claim 9 wherein said second liner includes a bottom opening, a top opening and a pair of panels defining side walls seamed together along edges thereof and includes apertures adjacent a top edge thereof oriented to locate with the bayonet pins on the reservoir.

11. The kit of claim 10 wherein said third further liner is formed as a blank of material having a medial line defining mirror symmetry on either side thereof, an arcuate one end, a diverging medial portion, an area of transition between said arcuate one end and said diverging medial portion including bayonet hook orifices slightly inboard said area of transition and in line with a central siphon orifice disposed on said-medial line, a peaked other end including a nozzle hole disposed on said medial line, and, at an outer periphery thereof, said third liner having a crested area generally aligned with said hole on a line perpendicular to said medial liner thereafter tapering to said peaked other end including a seam to join free ends of said blank thereby accentuating the peak.

12. A method for using a spray gun, the steps including:

opening the gun to expose the interior of the gun's reservoir, inserting a first liner into the reservoir, inserting a second liner about the reservoir before inserting the first liner, turning over a top edge of the first liner to align with bayonet pins on the reservoir, locking the liner to the gun, filling the first liner with fluid, closing the gun, and spraying.

13. The method of claim 12 including installing a third liner to a spray head over bayonet hooks on the spray head after filling the first liner with fluid and placing a free end of the third liner over a nozzle of the spray gun, just upstream from the nozzle outlet.

14. The method of claim 13 including forming means to secure said first liner to said reservoir including bayonet holes passing through said first liner and with bayonet pins contained on the reservoir, and turning over a top most portion of said first liner allowing access of said bayonet holes to locate the bayonet pins.

15. The method of claim 14 including forming said first liner with an axis of symmetry such that folding a diametral line of a bottom wall defining a portion of said first liner corresponds with the axis of symmetry, and forming a lower portion of said first liner as a substantially four ply rectangular panel, and when deploying reorienting the first liner such that a substantially cylindrical side wall is formed with a circular bottom wall and two pairs of gussets oriented adjacent each end of said axis of symmetry adjacent an inner portion of said side wall.

16. The method of claim 15 including forming said second liner with a bottom opening, a top opening and a pair of panels defining side walls and seaming the panels together along edges thereof placing apertures adjacent a top edge thereof, and orienting the apertures to locate with the bayonet pins on the reservoir.

17. The method of claim 16 including forming said third further liner as a blank of material with a medial line defining mirror symmetry on either side thereof, forming an arcuate one extending to a diverging medial portion, placing at an area of transition between said arcuate one end and said diverging medial portion bayonet hook orifices slightly inboard said area of transition and in line with a central siphon orifice formed by cutting on said medial line, peaking an other end including placing a nozzle hole on said medial line and at an outer periphery thereof said third liner cresting an area generally opposite said nozzle hole, thereafter tapering the third liner to a peaked other end including a seam to join free ends thereby accentuating the peak.

* * * * *